US005788000A

United States Patent [19]

Maury et al.

[11] Patent Number: 5,788,000

[45] Date of Patent: Aug. 4, 1998

[54] STABILIZER-REAMER FOR DRILLING AN OIL WELL

[75] Inventors: Vincent Maury, Idron Ousse Sendets; Jean-Claude Guerin, Idron Bizanos, both of France

[73] Assignee: Elf Aquitaine Production, France

[21] Appl. No.: 738,453

[22] Filed: Oct. 30, 1996

[30] Foreign Application Priority Data

Oct. 31, 1995 [FR] France ..... 95 12838

[51] Int. Cl.[6] ..... E21B 17/10

[52] U.S. Cl. ..... 175/325.1; 175/325.4

[58] Field of Search ..... 175/325.1, 325.2, 175/325.4

[56] References Cited

U.S. PATENT DOCUMENTS

| | | | |
|---|---|---|---|
| 2,634,957 | 4/1953 | Coyle | 255/76 |
| 2,679,383 | 5/1954 | Garrison | 255/76 |
| 3,050,122 | 8/1962 | Huitt et al. | 166/55.8 |
| 3,441,307 | 4/1969 | Farmer | 294/65.5 |
| 4,693,328 | 9/1987 | Furse et al. | 175/325.4 X |
| 4,842,083 | 6/1989 | Raney | 175/325.4 |
| 5,224,558 | 7/1993 | Lee | 175/325.4 |
| 5,265,675 | 11/1993 | Hearn et al. | 166/297 |
| 5,293,945 | 3/1994 | Rosenhauch et al. | 175/325.2 |
| 5,339,914 | 8/1994 | Lee | 175/325.4 |
| 5,341,888 | 8/1994 | Deschutter | 175/323 |

FOREIGN PATENT DOCUMENTS

| | | | |
|---|---|---|---|
| 0 251 543 | 1/1988 | European Pat. Off. | E21B 17/10 |
| 0 577 545 | 3/1993 | European Pat. Off. | E21B 10/32 |
| 2 132 633 | 11/1972 | France | E21B 23/00 |
| 192 753 | 12/1907 | Germany . | |
| 1 152 979 | 8/1963 | Germany . | |
| WO 93/11335 | 6/1993 | WIPO | E21B 17/10 |

*Primary Examiner*—William P. Neuder
*Attorney, Agent, or Firm*—Bacon & Thomas

[57] ABSTRACT

The subject of the present invention is a stabilizer-reamer for drilling an oil well. The invention provides an improvement to drillpipe string stabilizers used when drilling an oil well.

The purpose of the stabilizer, which forms the subject of the invention, is to allow the drillpipe string to be raised through fractured formations, in addition to its normal function of stabilizing the drillpipes.

To this end, it is fitted with retractable abrasive blades which make it possible to re-drill the fractured formations when the drillpipes are being raised and to avoid jamming in the well.

The main claims relate to the novel function of the stabilizer, to the geometry of its elements and to the mechanism of opening the blades.

8 Claims, 4 Drawing Sheets

STABILIZER-REAMER FOR DRILLING AN OIL WELL

BACKGROUND OF THE INVENTION

1. Field of the Invention

The present invention relates to a stabilizer-reamer for drilling an oil well.

2. Description of Related Art

When drilling oil wells, geological blocks are often encountered which include fractures, faults or bedding seams (such as clay-sandstone series or flysch) where particular instabilities may arise due to slips at these fractures, faults or bedding seams.

This mechanism causes a lateral shift leading to a kind of step in the longitudinal profile of the well. When the drillpipe string is being re-lowered, this irregularity may block advance of the bit if it has occurred in front of the bit in a previously drilled section. If this step occurs behind the bit, or behind a stabilizer, it impedes or even irretrievably blocks the raising of the drillpipe string. Blocking is firstly manifested by an increase in tension, in torque, in a loss of rotation, and finally jamming, preventing upward movement. When re-lowering a drillpipe string, the irregularity in the profile of the well may also block advance of the bit if it has occurred in front of the bit in a previously drilled section.

Conventional release means (tensioning, sliding) generally do no more than engage the jammed part more firmly in the site where it is jammed, finally resulting in complete jamming which requires the jammed part to be unscrewed and discarded, and the well to be deviated.

Jamming generally takes place when the drillpipe string is being raised, blocking the stabilizers whose diameter is equal to the nominal diameter of the hole and therefore wider than the diameter of the drillpipes.

When encountered during drilling, incidents of this type cause much time to be lost sites, a few weeks or a few months in the case of some drilling sites, which leads to additional costs due to outage of the drilling equipment, which may reach several millions of francs.

Studies have been carried out to produce special stabilizers, but to date all modifications have proved ill-suited to reaming the profile of a hole in which there are steps due to slips at fractures.

The subject of the present invention is therefore a stabilizer-reamer which makes it possible to re-bore formation unevenness in the well when raising or lowering the drillpipe string.

To do this, the invention provides a stabilizer which has an effective cutting system comprising retractible reinforced blades.

The stabilizer-reamer for drilling an oil well, which forms the subject of the invention, fitted at an intermediate point on a drilling string arranged in the well, is characterized in that it includes a body and at least one blade which can be moved, by an actuator arranged inside the body, from a first position inside the body to a second position in which the blade protrudes out of the body.

SUMMARY OF THE INVENTION

The characteristics and advantages of the present invention will emerge more clearly on reading the following description, given with reference to the appended drawings.

BRIEF DESCRIPTION OF THE FIGURES OF DRAWINGS

Figure 3A:
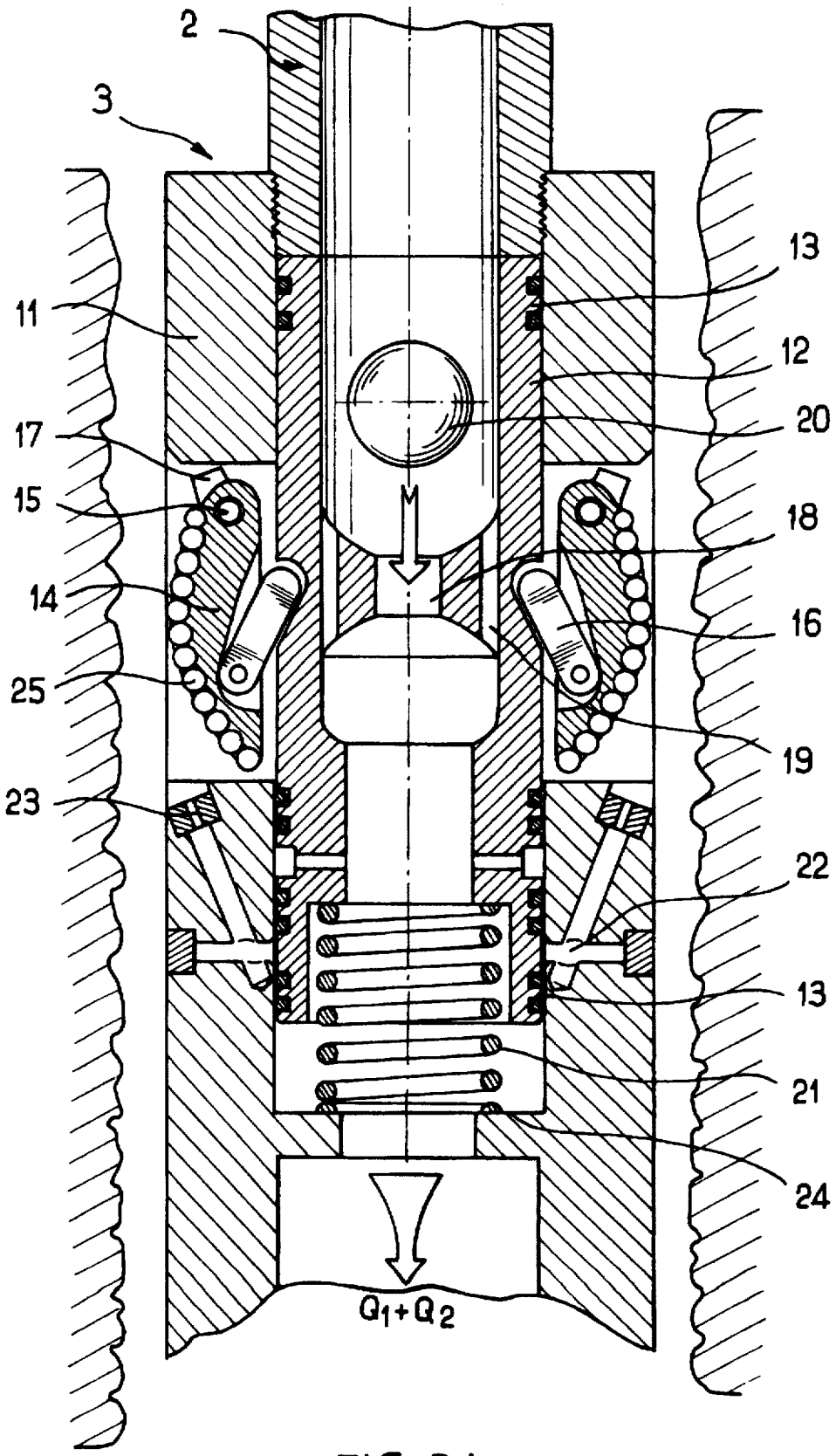
Figure 3B:
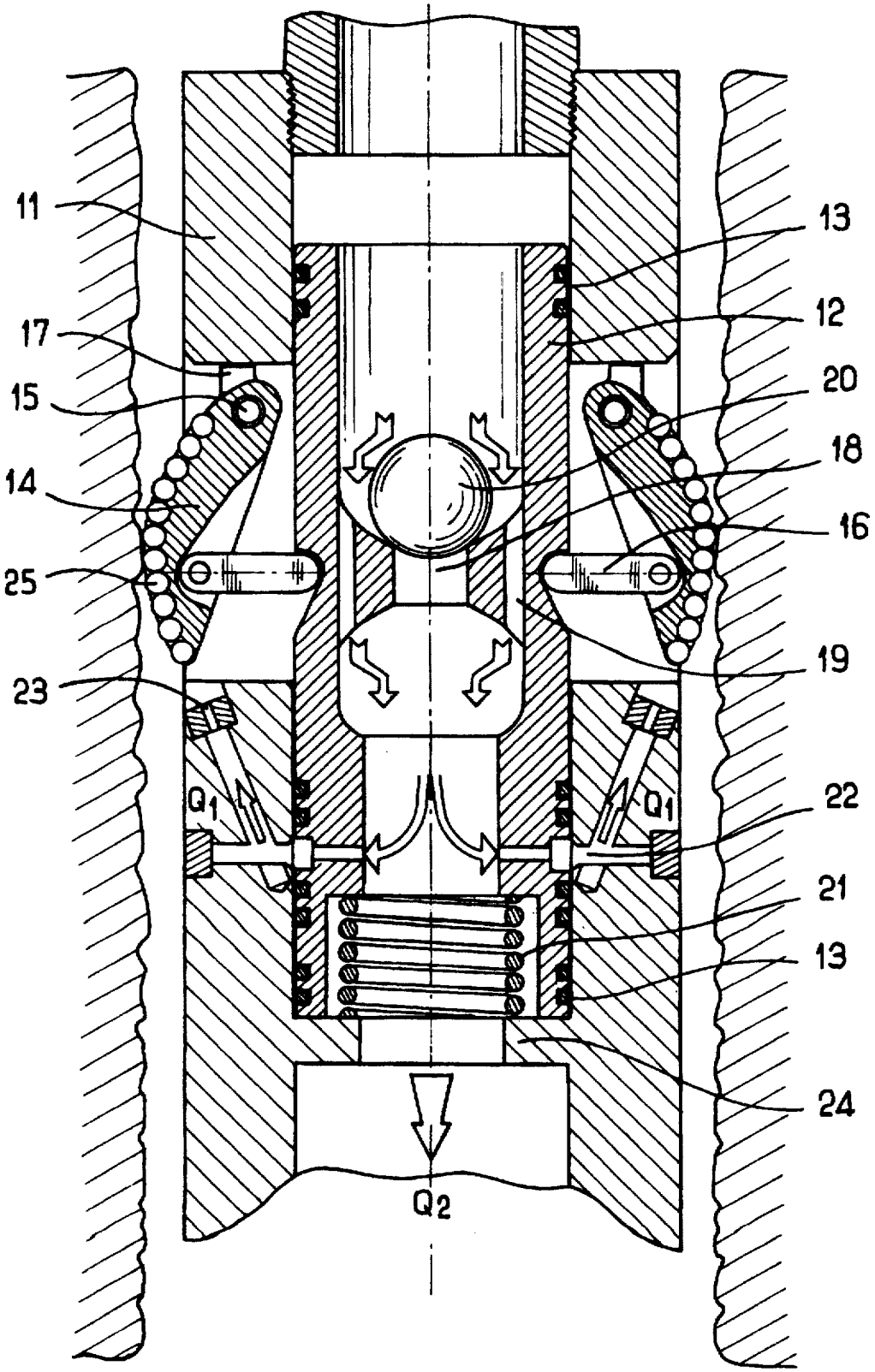

FIGS. 3A and 3B present the details of the stabilizer and of the reaming system according to the invention.

DETAILED DESCRIPTION OF THE INVENTION

Figure 1:
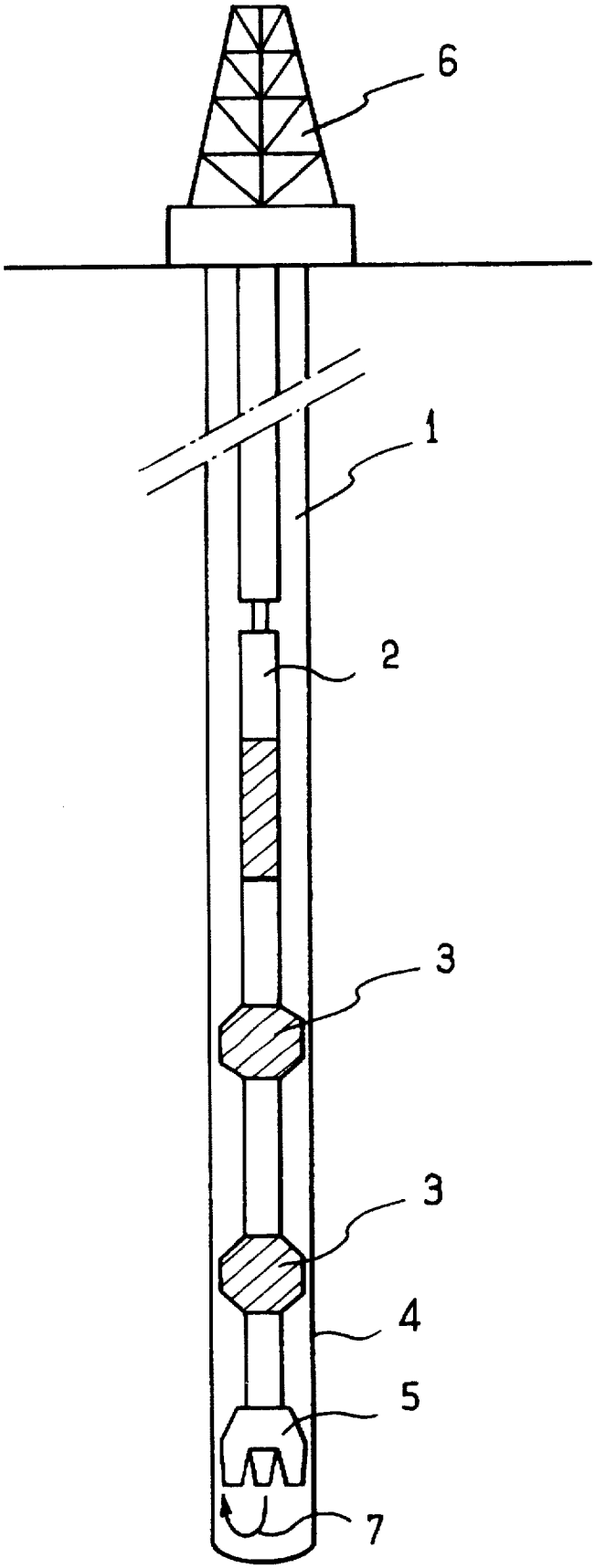
FIG. 1 is a schematic sectional view of an oil well.

FIG. 1 presents the overall section of an oil well, generally represented at (1), through which a drillpipe string (2) extends. The latter is also referred to as a drilling string and is fitted with stabilizers, (3) used to centre the drillpipes between the walls of the well (4), and with a drill bit (5) situated at the end of the drillpipe string.

Together, the drillpipe string, the stabilizers and the drill bit are driven in rotation using a motor located in a derrick (6).

Mud (7) flows through the well, downwards inside the drillpipes and upwards through the annular space between the drillpipes and the wall of the well.

The mud has several functions: lifting out cuttings, counter-balancing the pressure of the deposit by the static pressure due to the weight of the mud column, cooling the drill bit, and serving as a means allowing useful data regarding the drilling and the well to be transmitted to the drilling operator.

The stabilizers (3) are devices which are screwed in between two drillpipes, have the same diameter as the drill bit and are used for centring the drillpipes in the well in order to prevent them from vibrating laterally when the drilling string is being rotated.

Figure 2A:
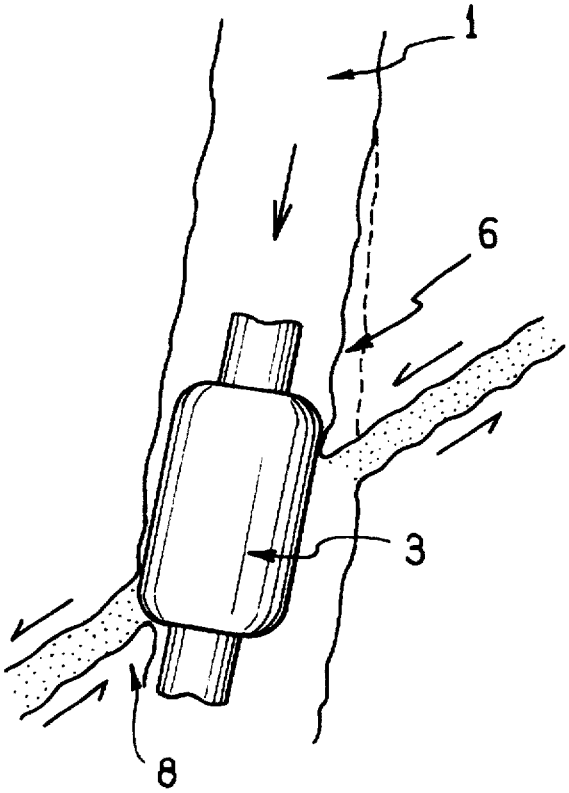
FIGS. 2A and 2B are sections of a well with formation slips.

FIG. 2A represents the section of a well (1) with a formation slip (6) on a clay seam (7). When the drillpipe string is being re-lowered into a previously drilled hole, the stabilizer encounters a step (8) which blocks the tool and which must therefore be re-bored.

Figure 2B:
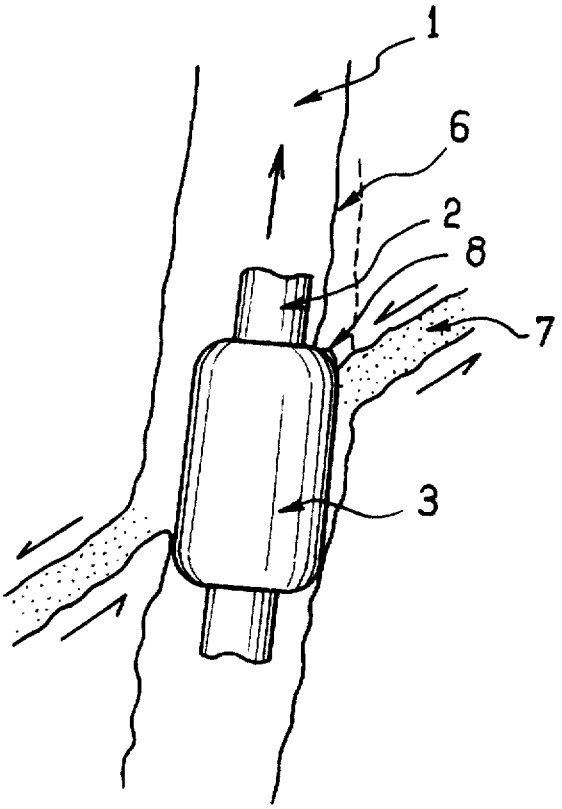

FIG. 2B represents the same slip phenomenon, with the stabilizer (3) jammed against a step (8) when the drillpipe string is being raised. The stabilizer can only pass this obstacle if the step is bored.

In order to allow re-boring, the stabilizer according to the invention comprises a retractible reaming system. As represented in FIG. 3A, the stabilizer consists of several elements:

- a body (11) which has external dimensions similar to those of conventional stabilizer bodies; the diameter of the body is equal to that of the drill bit.
- a control casing (12) is equipped with gaskets (13) at the top and bottom (when viewing the drawing) and seals the interior from the exterior when the tool is in its retracted position illustrated in FIG. 3A. Furthermore, the control casing (12) is provided with a ball support (18) which allows the mud to pass axially and also acts as a reinforcement. Mud flow vents (19) create the necessary head loss and therefore a force sufficient to move this casing to its extreme bottom when the ball (20) is in place (these vents can be closed off partially by plugs screwed in order to adapt to the flow rate employed),
- at least two blades (14), each fitted on one of its ends, which are equipped with diamond cutting tips (25), pivot on spindles (15) fixed to the body and can be manoeuvred by cranks (16) which take up all of the radial load without any axial reaction on the control casing (12). Arranged parallel to the axis of the drilling string, these blades have a curved shape and can therefore drill in both directions, upwards and downwards (when viewing the drawing), stops (17) secured to the blades prevent the blades from being opened beyond the nominal diameter of the hole to be repaired, a return spring (21) automatically returns the casing (12) to the top position (when viewing the drawing) when the flow of mud is reduced or stopped (tool closed). The assembly represented by the control case (12), the cranks (16) and the spring (21) constitutes the actuator which controls the blades, holes (22) and removable nozzles (23), through which the mud flows, ensure that the blades are cleaned. The mud flows inside the drillpipes (2) into the annular space (1) when the holes located in the control casing are aligned with the ones located in the body of the stabilizer.

The actuator (12), (16), (21) may be of a type other than the one presented in the invention. For example, piston or cam systems may be used for moving the blades apart.

The operation of the apparatus described above will now explained. During normal drilling (FIG. 3A), the return force of the spring (21) is such that the casing remains in the top position independently of the flow rate employed, and all the flow (Q1+Q2) passes through the drill bit.

In the case of abnormal friction when the drillpipe string is being raised, reaming must be carried out; a ball is then dropped from the surface, inside the drillpipes, and partially closes the axial mud passage (18); the overpressure generated by the head losses in the vents (19) causes descent of the activation casing (12) which opens the blades and diverts a part of the flow (Q1) onto them through the holes (22) and the nozzles (23) (FIG. 3B). The casing abuts against the bearing surface (24).

If the drilling operator decides to stop the reaming, he reduces the mud flow rate, which allows the casing to rise under the action of the spring and cause the blades to retract. Furthermore, sealing is reestablished between the interior and the exterior of the string, thus allowing better control of any inrush of hydrocarbons. Any subsequent increase in the flow rate reopens the cutting blades. Since the blades do not open beyond the nominal drilling diameter, any incident preventing them from closing will be of no great consequence (no jamming).

It is also possible to cause the control casing to rise by fishing up the ball. To do this, it is sufficient to lower a magnet on the end of a cable into the well.

There are three main advantages provided by this stabilizer-reamer:

it is possible to ream upwards and downwards, because of the curved shape of the blades (14) and the design of the crank (16) which keeps the blades deployed regardless of the direction of movement of the stabilizer, upwards or downwards, there is no risk of serious consequences resulting from malfunction of the stabilizer, since the maximum diameter of the blades when open does not exceed the diameter of the hole; there is no risk of the stabilizer jamming, the cutting elements remain in perfect condition for whenever they are required, since they are not employed during normal drilling, but only in exceptional circumstances.

We claim:

1. A stabilizer-reamer for drilling an oil well, intended to be fitted on a drilling string arranged in the well, comprising a substantially cylindrical body, at least two blades which can be moved, by an actuator arranged inside the body, from a first position inside the body to a second position in which the blades protrude out of the body and a control casing which can move axially in the body between a first position and a second position and is connected to the blades in such a way that movement of the casing causes the blades to move apart, said body having nozzles which open towards the outside of the body and said control casing including orifices which allow fluid communication between the interior of the body and the nozzles when the casing is in its second position.

2. Stabilizer-reamer according to claim 1, comprising at least two blades, each fitted on one of its ends, which pivot on spindles fixed to the body and are arranged parallel to the axis of the drilling string.

3. Stabilizer-reamer according to claim 2, wherein the blades are curved.

4. Stabilizer-reamer according to claim 1, wherein the control casing includes a seat intended to accommodate a ball in order to at least partially close off an axial passage for mud through the stabilizer.

5. Stabilizer-reamer according to claim 1, further comprising a spring which pushes the control casing towards its first position.

6. Stabilizer-reamer according to claim 2, wherein each blade includes a crank joining it to the control casing.

7. Stabilizer-reamer according to claim 1, wherein each nozzle is directed towards the associated blade when the latter is in its open position.

8. Stabilizer-reamer according to claim 4, wherein the ball can be fished up using a magnet attached to the end of a cable lowered into the well.

* * * * *